US012071772B1

(12) United States Patent
Ryan

(10) Patent No.: US 12,071,772 B1
(45) Date of Patent: Aug. 27, 2024

(54) COVE BASE SUPPORT

(71) Applicant: Aaron Ryan, Richmond, IN (US)

(72) Inventor: Aaron Ryan, Richmond, IN (US)

( * ) Notice: Subject to any disclaimer, the term of this patent is extended or adjusted under 35 U.S.C. 154(b) by 0 days.

(21) Appl. No.: 18/376,934

(22) Filed: Oct. 5, 2023

(51) Int. Cl.
*E04F 19/04* (2006.01)

(52) U.S. Cl.
CPC ..... *E04F 19/0477* (2013.01)

(58) Field of Classification Search
CPC ..... E04F 19/04; E04F 19/045; E04F 19/0459; E04F 19/0477; E04F 19/0481; E04F 19/049; E04F 19/0495; E04F 2019/0404; E04F 2019/0409; E04F 2019/0413; E04F 2019/0422; E04F 2019/0427; E04F 2019/0431; E04F 19/02; E04F 19/022; E04F 19/026; E04F 19/0436; E04F 19/0463; E04F 19/0468; E04F 19/0472; E04F 19/061; E04F 2019/0496; E04F 2019/044; E04F 2019/0445
See application file for complete search history.

(56) References Cited

U.S. PATENT DOCUMENTS 2,069,289 A 2/1937 Swendsen et al.
2,111,922 A * 3/1938 Borkenstein ..... E04F 19/04 52/273
2,203,119 A * 6/1940 Wollaeger ..... E04F 19/0468 52/718.02
2,887,739 A * 5/1959 Bensman ..... E04F 19/0468 52/288.1
3,055,773 A * 9/1962 Mosher ..... D06M 15/423 427/389
3,126,444 A * 3/1964 Taylor ..... H02G 3/0418 220/345.2
3,464,177 A 9/1969 Amato
3,786,171 A * 1/1974 Shira ..... H02G 3/0425 138/108
4,109,434 A * 8/1978 Katzin ..... E04F 19/04 52/288.1
4,165,577 A * 8/1979 Shanahan ..... A01M 1/223 43/99
4,569,171 A 2/1986 Kuhr et al.
(Continued)

FOREIGN PATENT DOCUMENTS

CA 2137609 C 6/2010
CN 109457978 A 3/2019
(Continued)

OTHER PUBLICATIONS

U.S. Appl. No. 10/125,501, filed Nov. 13, 2018, Rossi et al.
(Continued)

*Primary Examiner* — Kyle J. Walraed-Sullivan
(74) *Attorney, Agent, or Firm* — Frost Brown Todd LLP

(57) ABSTRACT

A cove base support is positioned between a wall and a cove base and includes a vertical support portion, an angled support portion, and a toe support portion. The angled support portion is positioned at the bottom of the vertical support portion and provides a transition to the toe support portion. The toe support portion extends downwards and away from the wall and provides support to a toe of the cove base. At least one of the vertical support portion and the toe support portion defines a plurality of apertures through which adhesive is placed to attach the cove base support to the wall through the apertures.

20 Claims, 4 Drawing Sheets

(56) References Cited

U.S. PATENT DOCUMENTS

| | | | | |
|---|---|---|---|---|
| 4,893,447 | A * | 1/1990 | Opp | E04H 3/10 52/287.1 |
| 5,014,486 | A * | 5/1991 | Mayle | E04D 13/1415 52/717.03 |
| 5,598,681 | A * | 2/1997 | DiGianni | H02G 3/0425 52/718.04 |
| 5,732,747 | A * | 3/1998 | Holliday | H02G 3/0425 52/220.5 |
| 5,930,973 | A * | 8/1999 | Preece | E04F 19/04 52/287.1 |
| 6,122,872 | A * | 9/2000 | Sauter | H02G 3/0425 52/287.1 |
| 6,189,276 | B1 * | 2/2001 | Pinto | E04F 19/04 52/287.1 |
| 6,287,046 | B1 * | 9/2001 | Neuhofer, Jr. | E04F 19/0463 16/16 |
| 6,401,418 | B1 * | 6/2002 | Senn | E04F 19/04 52/287.1 |
| 6,438,914 | B1 * | 8/2002 | Robertson | E04F 19/022 52/287.1 |
| 7,703,249 | B2 | 4/2010 | Rachak | |
| 7,861,486 | B2 * | 1/2011 | Hopkins | E04F 15/14 29/458 |
| 10,856,543 | B1 * | 12/2020 | Miranda | A01M 29/30 |
| 11,746,542 | B2 * | 9/2023 | Jones | E04F 19/061 52/287.1 |
| 2003/0145540 | A1 * | 8/2003 | Brunedal | H02G 3/0425 52/285.1 |
| 2005/0011159 | A1 * | 1/2005 | Standal | E04F 19/045 52/716.1 |
| 2005/0284055 | A1 * | 12/2005 | Piche | E04F 19/045 52/287.1 |
| 2006/0080925 | A1 * | 4/2006 | Rossetti | E04F 19/04 52/27 |
| 2006/0096203 | A1 | 5/2006 | Weinstein | |
| 2008/0202049 | A1 * | 8/2008 | Galas | E04F 19/0495 52/288.1 |
| 2008/0245006 | A1 * | 10/2008 | Rachak | E04F 19/04 52/287.1 |
| 2009/0092790 | A1 * | 4/2009 | Carnes | E04F 19/04 264/177.17 |
| 2011/0192101 | A1 * | 8/2011 | Johnston | E04B 2/7422 52/287.1 |
| 2012/0085048 | A1 * | 4/2012 | Higgins | E04F 19/0495 52/287.1 |
| 2014/0331595 | A1 * | 11/2014 | Seaver | E04F 19/0477 52/749.1 |
| 2016/0160510 | A1 * | 6/2016 | O'Brien | E04F 19/0477 52/287.1 |
| 2016/0362898 | A1 * | 12/2016 | Silk | E04F 19/0468 |
| 2017/0130467 | A1 * | 5/2017 | Neuhofer, Jr. | E04F 19/0468 |
| 2017/0183879 | A1 * | 6/2017 | Rossi | E04F 19/0477 |
| 2018/0195295 | A1 * | 7/2018 | Neuhofer, Jr. | E04F 19/0468 |
| 2019/0177983 | A1 * | 6/2019 | Klein | E04F 15/02044 |
| 2020/0141133 | A1 * | 5/2020 | Lavallie | E04F 19/061 |
| 2020/0340257 | A1 * | 10/2020 | Valentine | E04F 19/0477 |
| 2021/0095480 | A1 * | 4/2021 | Elliott | E04F 19/0436 |
| 2021/0156154 | A1 * | 5/2021 | Coyle, Jr. | E04F 19/0463 |
| 2022/0079109 | A1 * | 3/2022 | Carroll-Beer | E04F 19/045 |
| 2022/0381044 | A1 * | 12/2022 | Kontosic | E04F 19/0477 |
| 2023/0111277 | A1 * | 4/2023 | Shields | E04G 21/24 52/747.1 |

FOREIGN PATENT DOCUMENTS

| | | | | |
|---|---|---|---|---|
| DE | 10107866 | A1 * | 9/2001 | E04F 19/04 |
| DE | 20309519 | U1 * | 8/2003 | A47G 27/0456 |
| DE | 202005011138 | U1 * | 11/2005 | E04F 19/0468 |
| DE | 202005012466 | U1 * | 1/2006 | E04F 19/04 |
| DE | 202005011318 | U1 * | 2/2006 | H01Q 1/005 |
| DE | 202009002767 | U1 * | 6/2009 | E04F 19/045 |
| DE | 202009008932 | U1 * | 12/2009 | E04F 19/04 |
| GB | 661025 | A | 11/1951 | |
| GB | 2128223 | A * | 4/1984 | E04F 19/04 |
| GB | 2358650 | A * | 8/2001 | E04F 19/0436 |

OTHER PUBLICATIONS

U.S. Appl. No. 10/787,823, filed Sep. 29, 2020, Lavallie et al.

U.S. Appl. No. 11/156,006, filed Oct. 26, 2021, Hatch et al.

"Emac", Web Page < https://www.homedepot.com/p/Emac-Novorodapie-L-Matt-Silver-4-in-x-98-1-2-in-Aluminum-Baseboard_NRLAL100PL25/207033749>, retrieved on Jan. 29, 2024, 6 pages.

"Metal", Web Page <https://www.homedepot.com/p/10-ft-Metal-L-Bead-200TL5810H/202090334>, retrieved on Jan. 29, 2024, 4 pages.

"Tarkett Certifications", Web Page <https://tarkett.ecomedes.com/products/johnsonite/cove-filler-strips-vinyl>, retrieved on Jan. 29, 2024, 2 pages.

"Forbo", Web Page <https://www.forbo.com/flooring/en-ca/forbo-ezvations/armorcove/pk7g07>, retrieved on Jan. 29, 2024, 3 pages.

* cited by examiner

COVE BASE SUPPORT

BACKGROUND

Cove base is a flexible trim, often made of rubber or vinyl, that is adhered to the base of a wall. Cove base is generally used in commercial buildings and high traffic areas to provide an aesthetically pleasing transition between the drywall and flooring. Cove base also protects the base of the wall from damage caused by impacts from foot traffic, furniture, carts, equipment, and other items that may contact the base of the wall. However, cove base is constructed of a flexible material that can be damaged, warped, bent, and scuffed due to impact with furniture or other objects. While various types of cove base installation materials and techniques have been made and used, it is believed that that no one prior to the inventors has made or used the invention described herein.

BRIEF DESCRIPTION OF THE DRAWINGS

The accompanying drawings, which are incorporated in and constitute a part of this specification, illustrate embodiments of the invention, and, together with the general description of the invention given above, and the detailed description of the embodiments given below, serve to explain the principles of the present invention.

Figure 1:
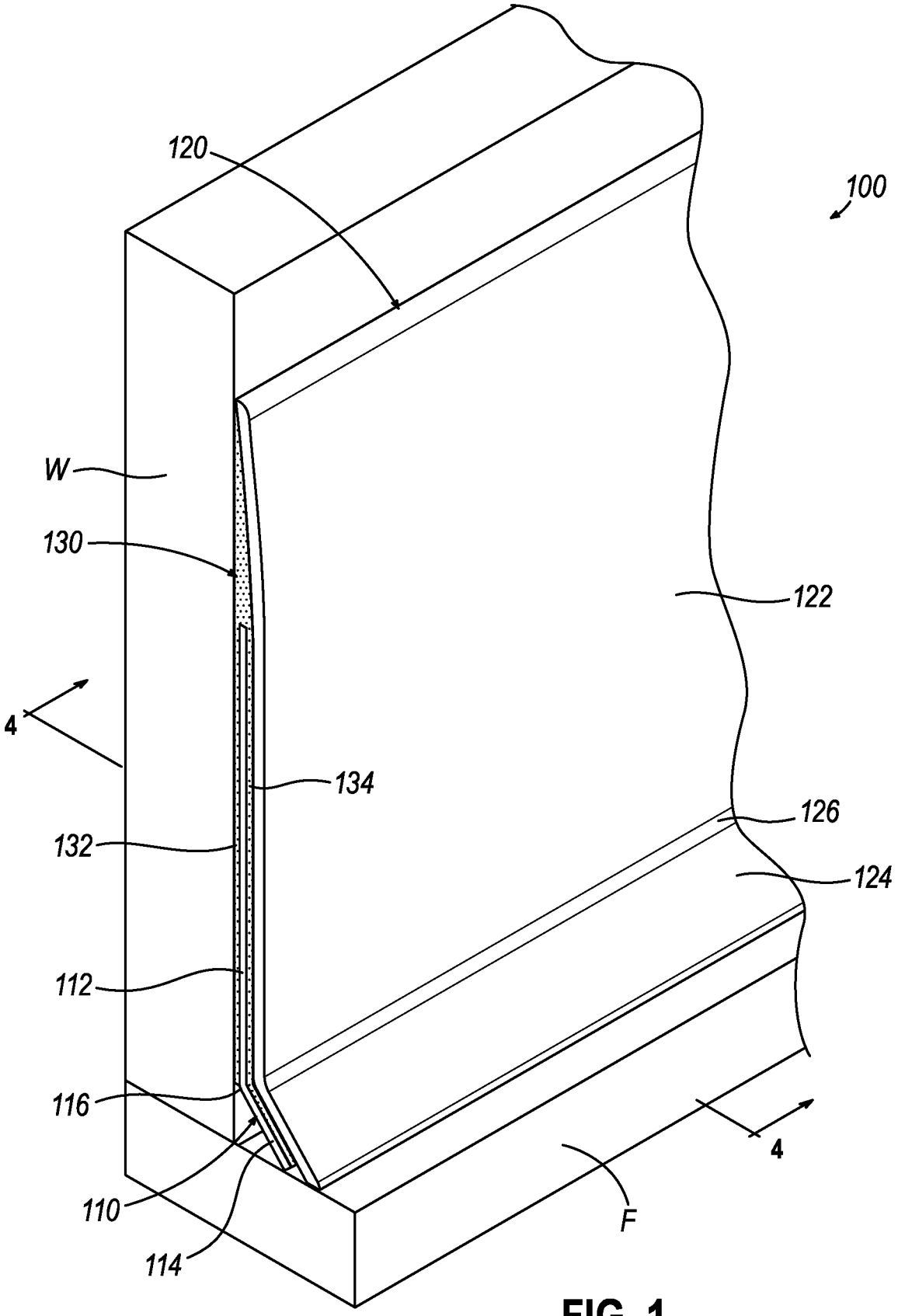
FIG. 1 depicts a perspective view of an exemplary cove base assembly including a cove base support and cove base installed on a wall.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

For clarity of disclosure, to the extent that spatial terms such as "top," "bottom," "upper," "lower," "vertical," "horizontal," or the like are used herein with reference to the drawings, it will be appreciated that such terms are used for exemplary description purposes only and are not intended to be limiting or absolute. In that regard, it will be devices such as those disclosed herein may be used in a variety of orientations and positions not limited to those shown and described herein.

Furthermore, the terms "about," "approximately," and the like as used herein in connection with any numerical values or ranges of values are intended to encompass the exact value(s) referenced as well as a suitable tolerance that enables the referenced feature or combination of features to function for the intended purpose described herein.

I. Exemplary Cove Base Support

In some instances, it may be desirable to provide a cove base backing in the form of a cove base support for cove base to prevent damage to the wall or the cove base. Cove base may be easily damaged without the cove base support. More specifically the toe of the cove base can be ripped, torn, or folded under itself, which destroys the aesthetics of the cove base. It should be noted, cove base supports are not integrally formed with the cove base before being incorporated into a cove base assembly. The cove base support provides the advantage of being able to be backwards integrated with a commercially available cove base and secured with a commercially available adhesive.

FIG. 1 shows a cove base assembly (100) attached to a wall (W) and positioned adjacent to a floor (F). Cove base assembly (100) includes a cove base support (110), a cove base (120), and an adhesive (130). The cove base (120) is constructed of rubber or vinyl and includes flexible properties. The cove base (120) has an unspecified length that may be coiled or may be pre-cut into standard lengths such as 6' or 20' at the factory. The cove base (120) generally has a consistent height of 2.5", 4", 4.5", 5", and 6" or other fixed height. The cove base may be a commercially available cove base.

The cove base (120) has an upper portion (122), a lower portion (124), and an angled portion (126). The upper portion (122) extends downward direction to the angled portion (126). The upper portion (122) may be planar in shape and extends vertically from the angled portion. The angled portion (126) deviates at an angle from the upper portion in a direction that goes away from the wall and toward the floor. The angle in various examples is approximately 30 degrees to approximately 60 degrees. In some examples, the angle is approximately 45 degrees. The angled portion (126) includes a sharp radius but may include a more sweeping radius. In some examples, the cove base is extruded with the desired cross-sectional form. In some other examples, the cove base (120) is extruded with a flat cross-section, then a sharp radius may be produced with a press or sheet metal brake, and the sweeping radius may be produced by an English wheel, or similar manufacturing machine. These methods of manufacture are not meant to be limiting but are merely examples of the way to form the angled portion. The lower portion (124) is more commonly known as the "toe" and extends from the angled portion (126) to the floor (F). The lower portion (124) includes a vertical height of 0.5", and the upper portion (122) includes the remaining vertical height. For example, cove base (120) with an overall height of 2.5", 4", 4.5", 5", and 6" will all have a lower portion (124) with a vertical height of 0.5" and an upper portion having a vertical height of 2", 3.5", 4", 4.5", and 5.5" respectively.

Adhesive (130) typically includes a bonding agent in the form of a liquid or aqueous solution. Adhesive (130) in the illustrated embodiment is a wet-set adhesive applied with a caulk gun or with a putty knife from a container. A wet-set adhesive is applied in a wet state, and after a period of time the wet-set adhesive transitions to a hard state. The adhesive (130) may be a commercially available construction adhesive. In other versions the adhesive may include a bonding agent (not shown) pre-applied to the wall side of the cove base support (110) with a protective film (not shown). The bonding agent is kept in the wet state by the protective film until removed just prior to adhering the cove base support (110) to the wall and a second protective film (not shown) on a cove base side of the cove base support (110) is removed prior to securing the cove base (120) to the cove base support (110).

Figure 2:
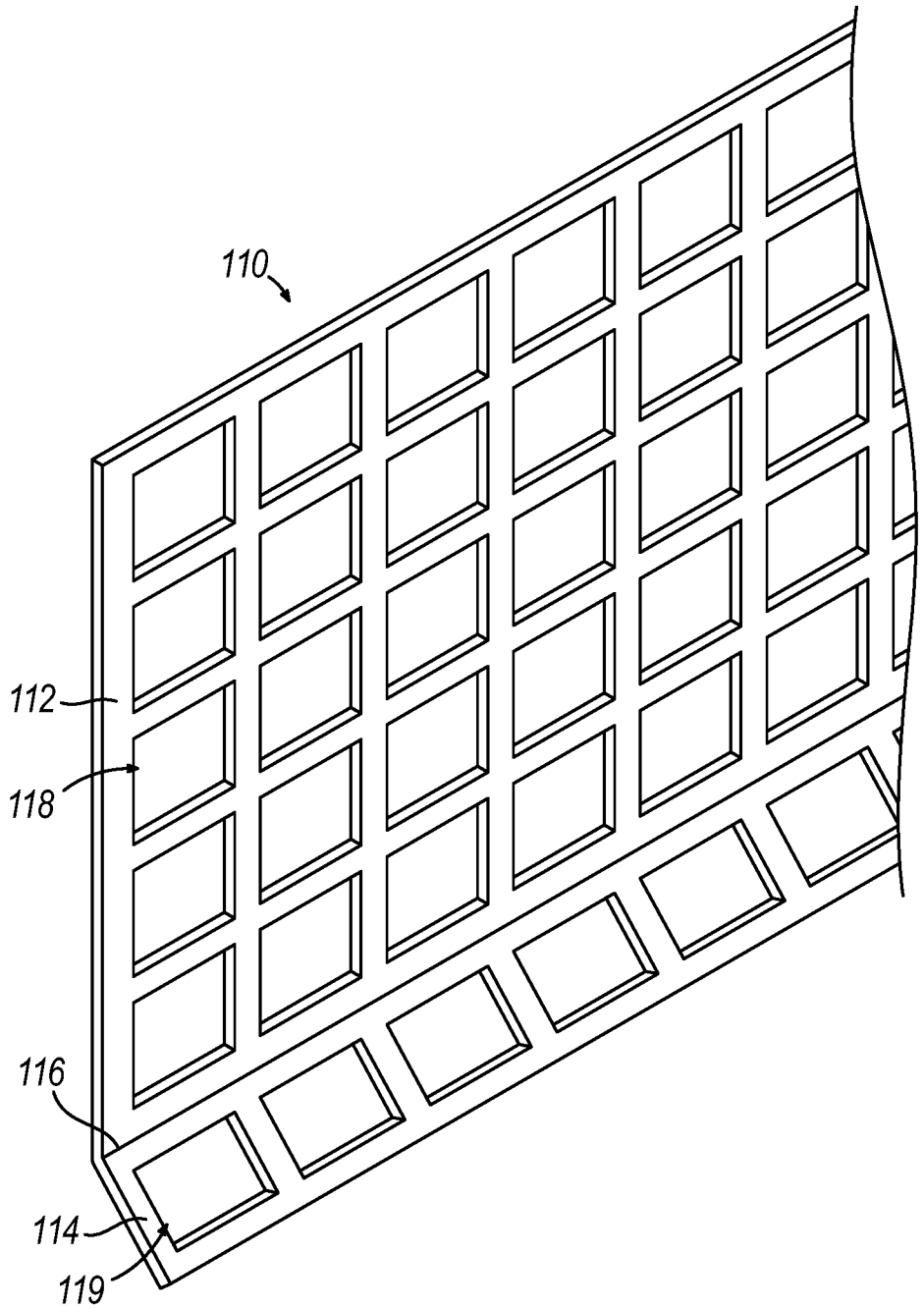
FIG. 2 depicts a perspective view of the cove base support of FIG. 1.

FIG. 2 shows an example cove base support (110). Cove base support (110) is constructed of a rust-proof material such as aluminum, stainless steel, or a mild steel coated with a rust inhibitor such as a primer, a paint, or a galvanized coating. Cove base support (110) may also be constructed of magnetic resonance imaging-safe materials such as aforementioned aluminum or titanium. In some versions, cove base support (110) may be constructed of plastic, fiberglass, carbon fiber, or any other materials known in the art to be sufficiently rigid and workable and to provide the desired support. The height of the cove base support (110) will correspond with the height of the cove base (120), being the same height or less so cove base support (110) does not extend beyond the height of the cove base (120). Cove base support (110) in this embodiment has a height slightly less than that of the cove base (120), namely, approximately 0.25" to approximately 1.25" less than in overall height than the height of cove base (120) that is generally available from standard suppliers. The preferred height of the cove base support (110) is 1" less than the overall height of the generally available cove base (120). For example, cove base supports (110) might be sized at approximately 1.5", approximately 3", approximately 3.5", approximately 4", or approximately 5" for cove base (120) having heights of 2.5", 4", 4.5", 5", and 6" respectively. A cove base support (110) sized for use with cove base (120) having a particular height may be used with a cove base having a greater height. For example, cove base support (110) having an overall height of 3" is also capable of supporting larger (4.5", 5", and 6") cove bases (120). A cove base support (110) having a lesser height than the preferred height relative to the cove base (12) is still capable of providing support where the support is most needed, namely, the lower portion (124) of the cove base (120). In these instances, a cove base support (110) having a height of 3" will have an overall height that is 1.5", 2", or 3" less than the respective overall height (4.5", 5," and 6") of the cove base (120). The cove base support (110) may have any of a variety of thicknesses, for example, from approximately 22 gauge to approximately 16 gauge, and in some embodiments 20 gauge.

Cove base support (110) includes a vertical support portion (112), an angled support portion (116), and a toe support portion (114). The vertical support portion (112) includes a planar shape and is configured to be placed against the wall (W). The vertical support portion (112) defines a plurality of vertical support apertures (118). As shown, the vertical support apertures (118) may have a square shape, or they may have a rectangular, circular, semicircular, oval, triangular, square, pentagonal, hexagonal, heptagonal, octagonal, nonagonal, decagonal, kite, trapezoidal, or any other shape known in the art to provide an improved bond by allowing an adhesive to be placed through the cove base support (110). The plurality of vertical support apertures (118) may also include various different shapes and sizes. The plurality of vertical support apertures (118) may be arranged in a linear array or in multiple linear arrays as shown (e.g., five linear arrays). The linear arrays extend along a length of the cove base support (110). In the alternative, the apertures may be staggered or randomly placed throughout the vertical support portion (112). The vertical support apertures (118) are configured to allow the adhesive (130) to flow through the vertical support apertures (118) to create a stronger bond between the vertical support portion (112) and the wall (W). As shown, the percentage of material removed from the vertical support portion (112) to create the vertical support apertures (118) is about 53% of the total material of the vertical support portion (112). The percentage of material that is omitted in a forming process or removed by drilling, milling, or punching may be as high as 68% and as low as 38%. It should also be noted that the cove base support (110) is a separate component from the cove base (120) before being incorporated into the cove base assembly (100).

Once installed, the vertical support portion (112) extends in a downward direction to the angled support portion (116). The angled support portion extends downwards and away from the wall toward the floor (F) at an angle that corresponds at least approximately with the angle of the angled portion (126), namely an angle of approximately 30 degrees to approximately 60 degrees, and a preferred angle of approximately 45 degrees.

The toe support portion (114) extends from the angled support portion (116) to the floor (F). The toe support portion (114) may rest on the floor (F) or be slightly above the floor (F). The toe support portion (114) is, in this example, a planar body, though in alternative embodiments it might be concave (that is, curved toward the floor relative to the illustrated plane) or have another contour. The toe support portion (114) defines a plurality of toe apertures (119). The toe apertures (119) are similar in shape, size, and arrangement to the vertical support apertures (118). As shown, the toe apertures (119) are rectangular-shaped, sized the same as the vertical support apertures (118), and arranged in a linear array extending along the cove base support (110). The toe apertures (119) may also be arranged in a random configuration. Toe apertures (119) may also be shaped differently from the vertical support apertures (118) and/or sized differently. As shown, toe apertures (119) include a removed portion of material that is 53% of the entirety of the material that makes up the toe support portion (114). The removed portion of material may be as high as 68% and as low as 38%. In some versions, the toe support portion (114) might not require apertures, in these versions the portion of material removed may be 0%. The percentage of removed material may be more or less than the vertical support portion (112), but as shown in FIG. 2, the toe apertures (119) have the same percentage of removed material as the vertical support apertures (118).

Figure 3:
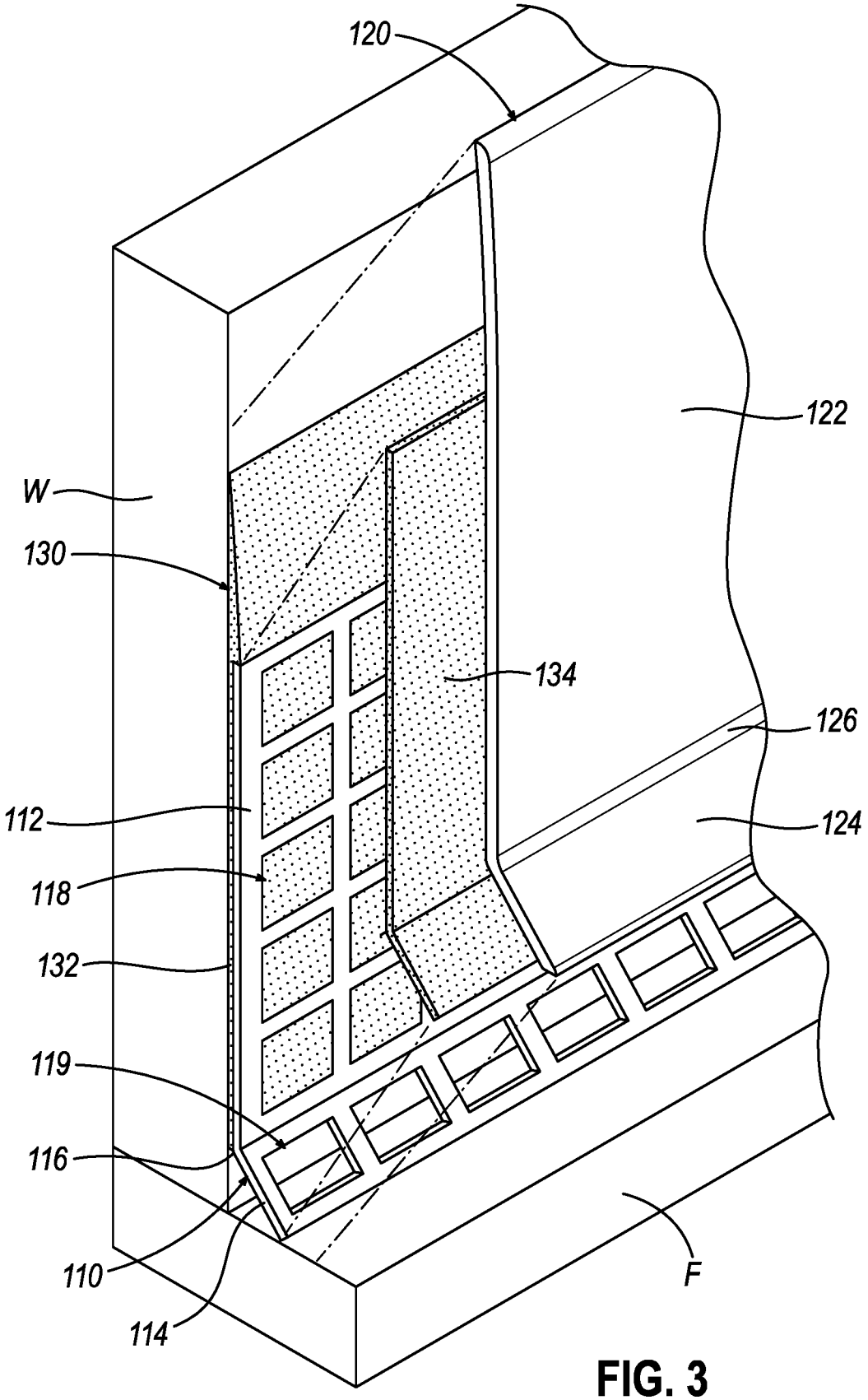
FIG. 3 depicts an exploded perspective view of the cove base assembly of FIG. 1 in a partially installed state.

FIG. 3 shows the cove base assembly (100) in a partially installed state with the cove base support (110) adhered to the wall (W) with an adhesive (130). FIG. 3 also shows the alignment of the cove base (120) and remaining adhesive (130) that will be used to adhere the cove base (120) to the cove base support (110). The cove base assembly (100) is installed by a first layer of adhesive (132) being liberally applied to the wall (W). In the alternative, a wall side of the cove base support (110) is "buttered" with adhesive (130) before the cove base support (110) is firmly pressed against the wall (W). In some instances, the first layer of adhesive (132) will pass through the vertical support apertures (118) and will be deposited on a cove base side of the cove base support (110). The first layer of adhesive (132) is also applied to the wall (W) above the cove base support (110). The cove base (120) is pressed against the cove base support (110). The cove base (120) bonds to the cove base support (110) with the adhesive that was pushed through the vertical support apertures (118). The cove base assembly (100) may then be rolled with a rigid hand roller to apply even pressure against the cove base (120) to distribute the adhesive (130) and smooth the cove base assembly (100) for a finished look.

In an alternative, the adhesive (130) is applied in two layers. The first layer of adhesive (132) is applied to the wall (W), and the cove base support (110) is pressed against the first layer of adhesive (132). A second layer of adhesive (134) is applied above the cove base support (110) on a surface area of the wall (W) that extends above the cove base support (110). The second layer of adhesive (134) is also applied to the cove base side of the cove base support (110), including the vertical support portion (112) and the toe support portion (114). The cove base (120) is pressed firmly against the cove base support (110). The cove base assembly (100) may then be rolled with a rigid hand roller to apply even pressure against the cove base (120) to distribute the adhesive (130) accordingly.

Figure 4:
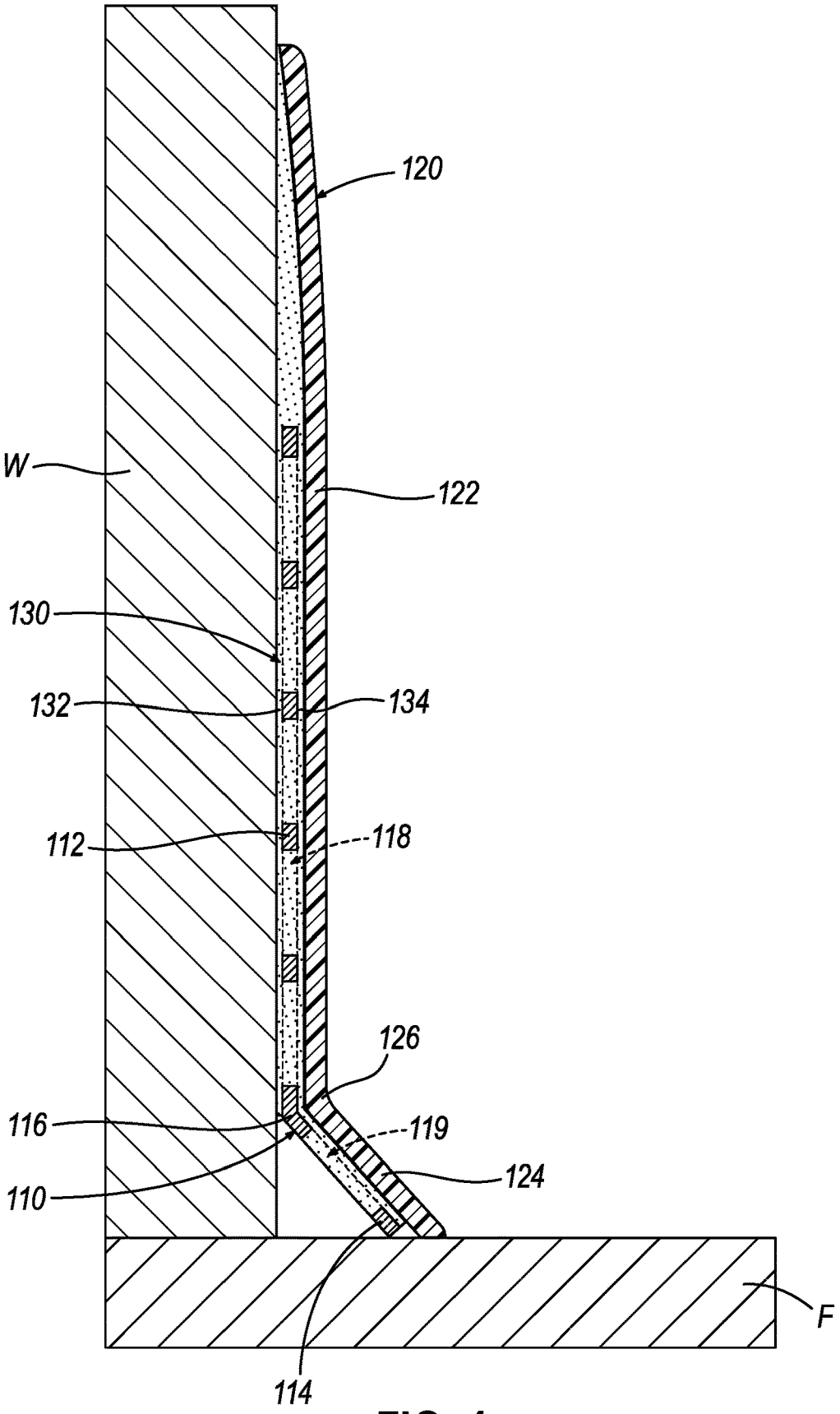
FIG. 4 depicts a cross-sectional side view of the cove base assembly of FIG. 1 in a fully installed state, taken along section line 4-4 in FIG. 1.

FIG. 4 shows the cove base assembly (100) in a fully installed state. The cove base support (110) is encapsulated by the adhesive (130) and the cove base (120). The adhesive (130) has been distributed by rolling or otherwise. The adhesive (130) is positioned on a wall side of the cove base support (110); above the cove base support (110) between the wall (W) and the upper portion (122) of the cove base (120); and on a cove base side of the cove base support (110).

III. Miscellaneous

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should also be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various embodiments of the present invention, further adaptations of the methods and systems described herein may be accomplished by appropriate modifications by one of ordinary skill in the art without departing from the scope of the present invention. Several such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. A cove base support, comprising:

(a) a vertical support portion, wherein the vertical support portion is configured to be positioned between a wall and a cove base, where the cove base is not of a single piece with a flooring material;

(b) an angled support portion; and (c) a toe support portion that extends downward and away from the angled support portion, wherein the toe support portion is configured to provide support to a toe of the cove base, wherein a lowermost distal end portion of the toe support meets the flooring material at an angle, and wherein the entire angled support portion is positioned vertically between the vertical support portion and the toe support portion.

2. The cove base support of claim 1, wherein the vertical support portion defines a plurality of apertures.

3. The cove base support of claim 2, wherein the plurality of apertures define 53% of the vertical support portion.

4. The cove base support of claim 2, wherein at least some of the apertures are different sizes.

5. The cove base support of claim 2, wherein the apertures are arranged in at least one linear array along a length of the cove base.

6. The cove base support of claim 5, wherein the at least one linear array comprises a first linear array and a second linear array, and wherein the second linear array is spaced apart from and parallel to the first linear array.

7. The cove base support of claim 1, wherein the toe support portion defines a plurality of apertures.

8. The cove base support of claim 1, wherein the vertical support portion and the toe support portion each define a plurality of apertures.

9. The cove base support of claim 1, further comprising an adhesive configured to bond the cove base to the wall.

10. The cove base support of claim 1, wherein the angled support portion corresponds to an angle of an angled portion of the cove base.

11. The cove base support of claim 1, wherein an angle of the angled support portion is approximately 45 degrees.

12. The cove base support of claim 1, wherein an angle of the angled support portion is between approximately 30 degrees and approximately 60 degrees.

13. The cove base support of claim 1, wherein the toe support portion is linear.

14. The cove base support of claim 1, wherein the toe support portion is arcuate.

15. The cove base support of claim 1, the cove base support comprising plastic.

16. A cove base assembly comprising:

(a) a cove base;

(b) an adhesive; and (c) a cove base support according to claim 1.

17. The cove base assembly of claim 16, wherein the vertical support portion of the cove base support defines a plurality of apertures.

18. The cove base assembly of claim 17, wherein the adhesive is a liquid adhesive configured to be applied to at least one of the wall or the vertical support portion and is configured to adhere to both the wall and the vertical support portion through the apertures.

19. A method of installing the cove base support of claim 1, comprising:

(a) placing the cove base support against the wall and directly over a top surface of the flooring material; and (b) placing the cove base over a whole outwardly facing surface of the cove base support along the top surface of the flooring material, wherein the outwardly facing surface faces away from the wall.

20. The method of claim 19, further comprising applying adhesive to at least one of the wall or the cove base support before placing the cove base over the cove base support.

* * * * *